US006694628B2

(12) United States Patent
Kojima et al.

(10) Patent No.: US 6,694,628 B2
(45) Date of Patent: Feb. 24, 2004

(54) CUTTING MACHINE

(75) Inventors: Naoki Kojima, Tokyo (JP); Mitsugi Shimoda, Tokyo (JP)

(73) Assignee: Max Co., Ltd., Tokyo (JP)

( * ) Notice: Subject to any disclaimer, the term of this patent is extended or adjusted under 35 U.S.C. 154(b) by 105 days.

(21) Appl. No.: 10/107,836

(22) Filed: Mar. 28, 2002

(65) Prior Publication Data

US 2002/0139230 A1 Oct. 3, 2002

(30) Foreign Application Priority Data

Mar. 30, 2001 (JP) ..... P2001-102550

(51) Int. Cl.[7] ..... B26D 5/00; B43L 13/00

(52) U.S. Cl. ..... 33/32.4; 101/484; 83/360

(58) Field of Search ..... 33/32.4, 18.1, 33/18.2, 32.1, 32.2, 32.3, 732, 735, 739, 740, 743, 745; 101/484; 83/360, 367, 369, 370, 371, 563, 614, 76.6, 76.7

(56) References Cited

U.S. PATENT DOCUMENTS

| | | | | | |
|---|---|---|---|---|---|
| 5,214,590 | A | * | 5/1993 | Schnetzer | 83/76.6 |
| 5,555,009 | A | | 9/1996 | Hevenor et al. | 347/198 |
| 6,006,436 | A | * | 12/1999 | Kuehl | 33/18.1 |
| 6,013,017 | A | * | 1/2000 | Aizawa | 83/563 |
| 6,112,630 | A | | 9/2000 | Miura | 83/76.6 |
| 6,202,527 | B1 | | 3/2001 | Heller | 83/368 |
| 6,308,602 | B1 | * | 10/2001 | Gerber | 83/76.6 |
| 2001/0049989 | A1 | | 12/2001 | Takeuchi | 83/614 |

FOREIGN PATENT DOCUMENTS

| | | |
|---|---|---|
| DE | 195 19 445 A1 | 11/1995 |
| EP | 0 469 249 A1 | 2/1992 |
| EP | 0 960 740 A1 | 12/1999 |
| JP | 1 162 046 A2 | 12/2001 |
| JP | 2001-347486 | 12/2001 |

* cited by examiner

*Primary Examiner*—Christopher W. Fulton
(74) *Attorney, Agent, or Firm*—Morgan, Lewis & Bockius LLP

(57) ABSTRACT

The cutting machine includes a sheet-driving unit, a detection sensor, and a cutter. The machine operates the sheet-driving unit and the cutter based on given input data to cut the sheet. The cutting machine calculates a length of sheet necessary to perform a cutting operation based on the input data, feeds out the sheet by the sheet-driving unit, and then performs a given cutting operation based on the input data without fully returning the sheet fed out by the driving unit after the cutting machine detects whether the sheet of the necessary length as calculated above is placed with using the detection sensor.

1 Claim, 5 Drawing Sheets

CUTTING MACHINE

BACKGROUND OF THE INVENTION

1. Field of the Invention

The present invention relates to a cutting machine for cutting out the contours of characters, symbols, and so on from a sheet.

2. Description of the Related Art

As a conventional cutting machine, there is one disclosed in Japanese patent application No. 2000-173653. This cutting machine is apparatus for cutting out desired contours of characters and symbols from a relatively wide sheet having a given length to obtain a pressure-sensitive adhesive sheet from which the contours of characters and symbols have been cut out or in which the contours are left.

The conventional cutting machine has a dedicated input device connected with the machine with a cable. Using this input device, characters and symbols to be cut out, the font of the characters and symbols, and their sizes and positions are entered. The machine cuts out the contours of the desired characters and symbols based on the entered data.

The conventional cutting machine described above performs a first operation. That is, the machine checks whether there is a sufficient amount of sheet to cut out all characters entered. In particular, if the cutting operation is performed while the remaining amount of sheet is left unchecked, the cutting operation can no longer be continued if the sheet to be cut runs out. The sheet currently being cut is also wasted. For these reasons, the remaining amount of sheet is checked at first. The adopted method of checking the remaining amount of sheet consists of once pulling (feeding) a full amount of sheet necessary for a cutting operation out of a sheet loader and checking if the necessary amount of sheet remains at this time using a sensor.

Secondly, after checking the remaining amount of sheet as described above, the sheet pulled out is entirely returned. Then, the sheet is cut based on entered cutting data.

In some cases, a cutting machine is connected with a terminal such as a personal computer. Data is entered using the personal computer as an input device, and fonts and characters of various designs are cut out. In these cases, the cutting machine receives data (coordinate data) about the motion of the cutter from the personal computer, and performs a cutting operation based on the data. The coordinate data sent from the personal computer to the cutting machine does not always start from the front end of the sheet. Depending on the control software in the personal computer, the cutting may be started from an intermediate position in the sheet.

The conventional cutting machine described above did not take account of the connectivity with the personal computer at first. On the assumption that cutting is started from the front end of a sheet, the sheet is fed out to check the remaining amount of sheet and the sheet is entirely returned. Then, cutting is started. Therefore, one must wait at least for a time taken for the sheet to make one reciprocation from the checking of the remaining amount of sheet up to the beginning of the cutting.

In some kind of machine, data is entered into the conventional cutting machine with using a personal computer as an input device, and symbols and characters of various designs are cut. Also, in this case, the remaining amount of sheet is once pulled out and a check is made. Then, the sheet is returned to its original position. Subsequently, cutting is started based on coordinate data from the personal computer. That is, the sheet is reciprocated fully once and then the sheet is again sent to a desired position, and then the cutting is started. Consequently, time is wasted in feeding the sheet from the checking of the remaining amount of sheet up to the start of the cutting.

SUMMARY OF THE INVENTION

The present invention has been made in view of the foregoing. It is an object of the present invention to provide a novel cutting machine that shortens the time from the checking of the remaining amount of sheet to the beginning of cutting, unlike the conventional cutting machine, to thereby shorten the total cutting time.

To solve the foregoing problem, a cutting machine according to the present application includes:

- a placement portion on which a sheet is placed so as to be movable longitudinally thereof, the sheet having a given width and a considerable amount of length as compared with the width;
- a sheet-driving unit for moving the sheet placed on the placement portion longitudinally;
- a detection sensor for detecting whether the sheet placed on the placement portion is present or not;
- a cutter unit capable of moving in a direction perpendicular to the direction of movement of the sheet made by the sheet-driving unit; and
- a control unit for controlling the sheet-driving unit and the cutter unit,
- wherein the cutting machine operates the sheet-driving unit and the cutter unit based on given input data to cut the sheet, and
- wherein the cutting machine calculates a length of the sheet necessary to perform a cutting operation based on the input data by means of the control unit, feeds out the sheet by the sheet-driving unit based on results of the calculation, and performs a given cutting operation based on the input data without fully returning the sheet fed out by the driving unit after the cutting machine detects whether the sheet of the necessary length found by the calculation is placed with using the detection sensor.

DETAILED DESCRIPTION OF THE PREFERRED EMBODIMENTS

Figure 1:
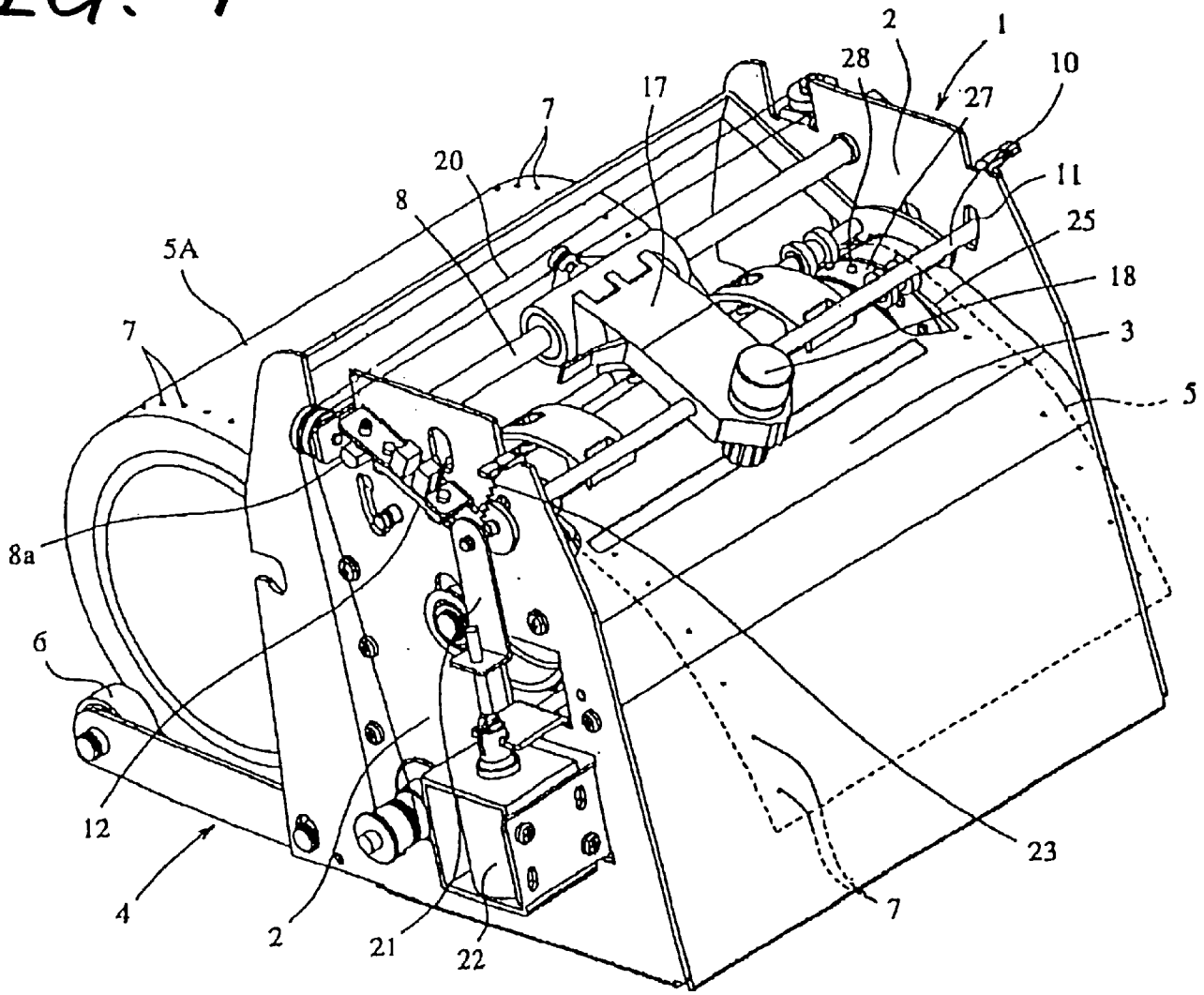
FIG. 1 is a perspective view of a cutting machine according to the present invention, illustrating the appearance thereof.
Figure 2:
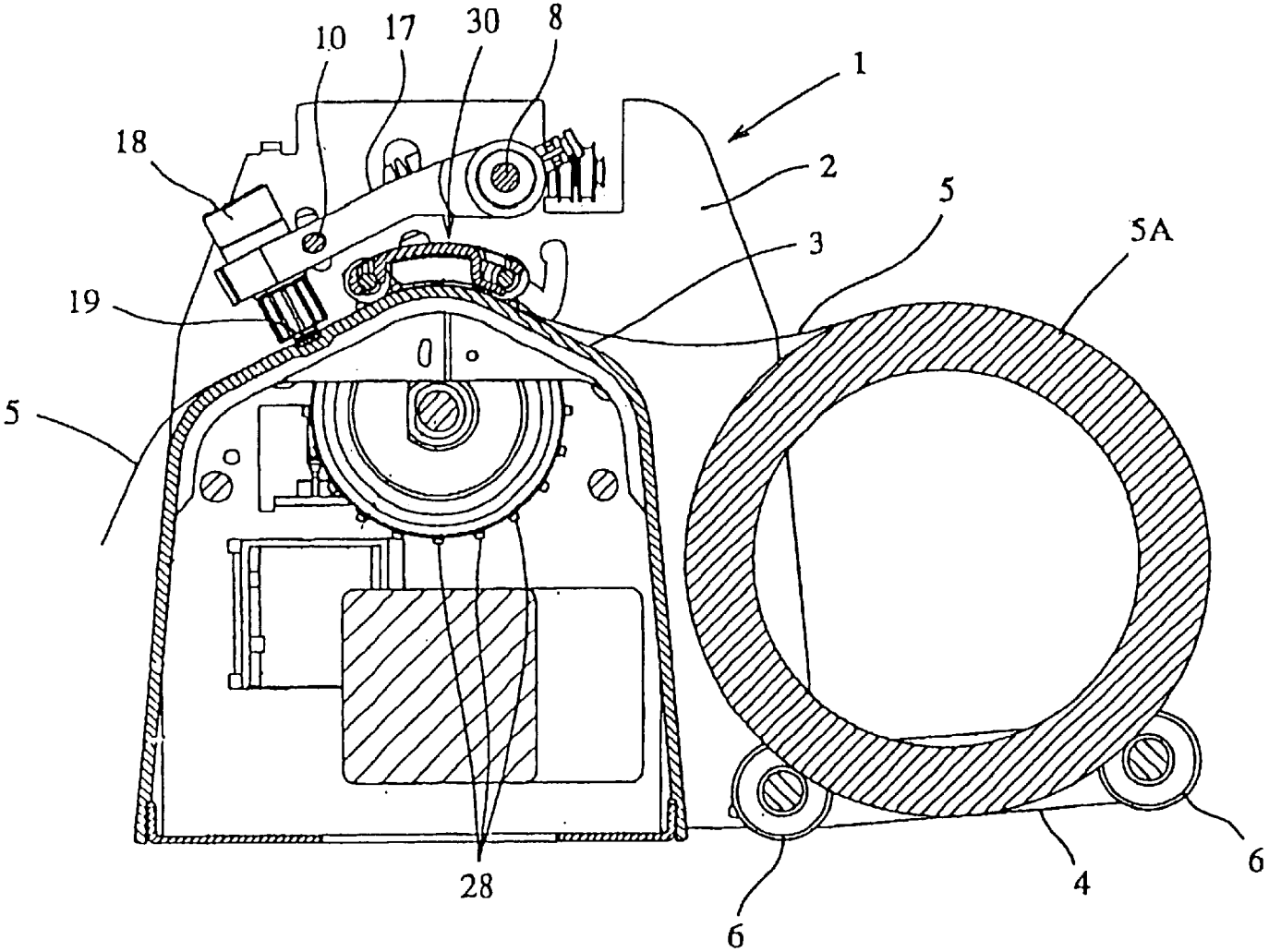
FIG. 2 is a side elevational view of the cutting machine according to the invention.

An embodiment of a cutting machine according to the present invention is hereinafter described with reference to the drawings. FIGS. 1 and 2 show the appearance of the body 1 (hereinafter referred to as "the body") of the cutting machine according to the invention. This machine is identical with the conventional cutting machine in fundamental mechanism. This mechanism is briefly described below.

A pair of right and left side bases 2 are flat plate members to which various members forming the body 1 are mounted.

A sheet base 3 is located between the right and left side bases 2. A sheet 5 (described later) is placed on this sheet base 3, which is a plate member and substantially curved into an arc so as to be slidable. A detection sensor 49 (sheet sensor, which is described later), not shown in the drawings, for detecting whether the sheet 5 is placed on the sheet base 3 is mounted on the sheet base 3.

Holding arms 4 are members acting to rotatably hold a sheet roll 5A obtained by winding the sheet 5 into a roll. The holding arms 4 are narrow plate members mounted to the right and left side bases 2, respectively. Holding rollers 6 resembling shafts extend to the right and left holding arms at the base and edge portions of the arm 4.

The aforementioned sheet 5 is produced by bonding release paper to the rear surface of a sticky sheet material so as to form a narrow sheet. This sheet has a given width and a considerable amount of length as compared with the width. That is, in the present embodiment, the sheet assumes a contour resembling somewhat wide tape. Holes 7 are formed at regular intervals near both side ends of the sheet 5. These holes 7 are formed at the same pitch as driving protrusions 28 formed on the outer surface of a driving roller 27 (described later). The holes are designed to engage with the driving protrusions 28.

A guide shaft 8 is mounted between the side bases 2, and is a member for slidably holding a driving arm 17 that is a cutter means. The driving arm 17 is a member for holding a cutter head 18 on which a cutter 19 for cutting the sheet 5 is mounted.

An up-down bar 10 moves up and down along slots 11 formed in the side bases 2, respectively. The up-down bar 10 is coupled to arms 12 rotating coaxially with the guide shaft 8 outside each of the side bases 2. The arms 12 are coupled to a solenoid 22 via connecting bars 21. As the solenoid 22 is driven, the arms 12 swing coaxially with the guide shaft 8. Because of the structure described thus far, the guide shaft 8 whose opposite ends are coupled to the arms 12 moves up and down as the solenoid 22 is driven. During deenergization, the arms 12 are biased upward by return springs 23 to keep the guide shaft 8 elevated.

The up-down bar 10 passes through a hole formed in the driving arm 17, and up-down motion of the up-down bar 10 is transmitted to the driving arm 17 via the hole.

A driver wire 20 is coupled to the driving arm 17 and designed to move the driving arm 17 along the guide shaft 8. The driver wire 20 is driven by a pulse motor PM2 (described later).

The driver roller 27 has the driving protrusions 28 on its outer surface. The driver roller has peripheral portions which are exposed from right and left notches 25 formed in the sheet base 3 such that the driver roller is placed opposite to the holes 7 formed near both side ends of the sheet 5 and the sheet engages with the driving protrusions 28. The driver roller 27 is driven by a pulse motor PM1 (described later).

A sheet presser 30 is mounted which provides a cover over the engaging portion in order to prevent the sheet 5 engaging with the driving protrusions 28 from coming off them.

Figure 3:
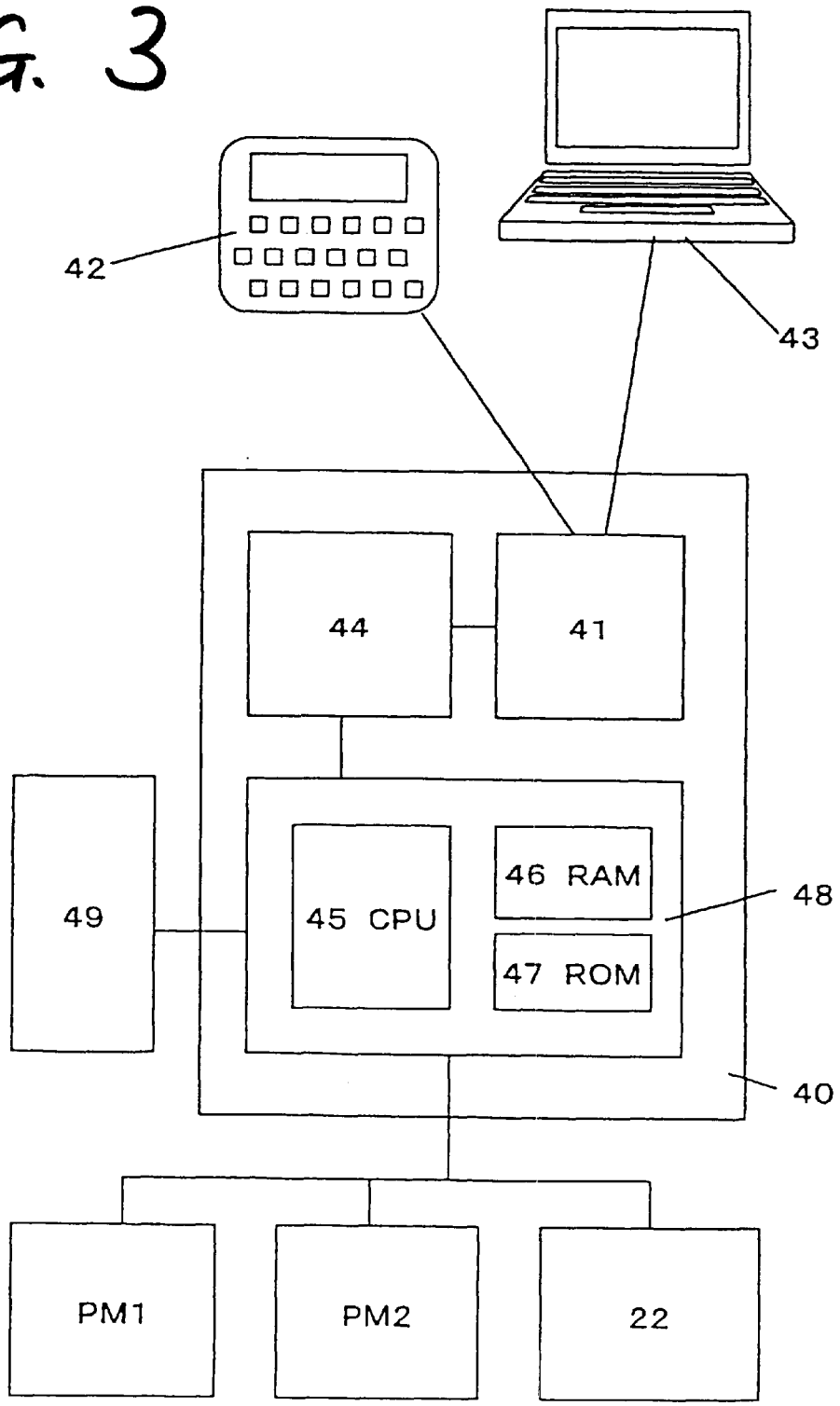
FIG. 3 is a block diagram showing electrical specifications of the cutting machine according to the invention.

The mechanism of the body 1 has been briefly described thus far. Its electrical specifications are described next. FIG. 3 is a block diagram showing the electrical specifications of the body 1.

A control portion 40 includes a CPU 45, a RAM 46, and a ROM 47, and controls the operation of the body 1 based on a given program.

An interface 41 is used to connect a dedicated input terminal 42 and a personal computer terminal 43 (so-called personal computer) with the body 1. Data about cutting such as characters is entered into the body 1 via the interface 41 as described later.

A data buffer 44 is constituted by a RAM and acts to sequentially store cutting data entered from the interface 41 and send the data to the CPU 45 sequentially.

A processor portion 48 has the CPU 45 as its main component. In addition, the portion 48 has the RAM 46 and the ROM 47. The processor portion controls the body 1 based on a master program stored in the ROM 47. The processor portion 48 calculates cutting data stored in the data buffer 44 and computes a length of the sheet 5 necessary for cutting.

The sheet sensor 49 is one of various sensors incorporated in the body 1 and acts to detect the presence or absence of the sheet 5 on the sliding plate 3.

Indicated by PM1 is the pulse motor including a driver used for driving. The pulse motor PM1 rotates the driver roller 27 according to instructions from the CPU 45 as mentioned previously, and moves the sheet 5 on the sliding plate 3.

Indicated by PM2 is a pulse motor including a driver for driving. The pulse motor PM2 drives the driver wire 20 as mentioned previously to move the driving arm 17.

Indicated by 22 is the aforementioned solenoid including a driver for driving. The solenoid 22 moves the up-down bar 10 up and down according to instructions from the CPU 45. When the driving arm 17 is biased downward, the cutter 19 held to the underside of the cutter head 18 can touch and cut the sheet 5. When the driving arm 17 is biased upward, the cutter 19 held to the underside of the cutter head 18 moves away from the sheet 5 and does not cut.

The cutter 19 is pressed against the sheet 5 at such a pressure that the peel paper of the sheet 5 is not cut and that only the sheet member at the front layer is cut out.

A cutting operation of the cutting machine according to the invention on the sheet is next described. As an example, a case in which the sheet 5 is cut to extract characters "ABCD" is described.

Figure 4:
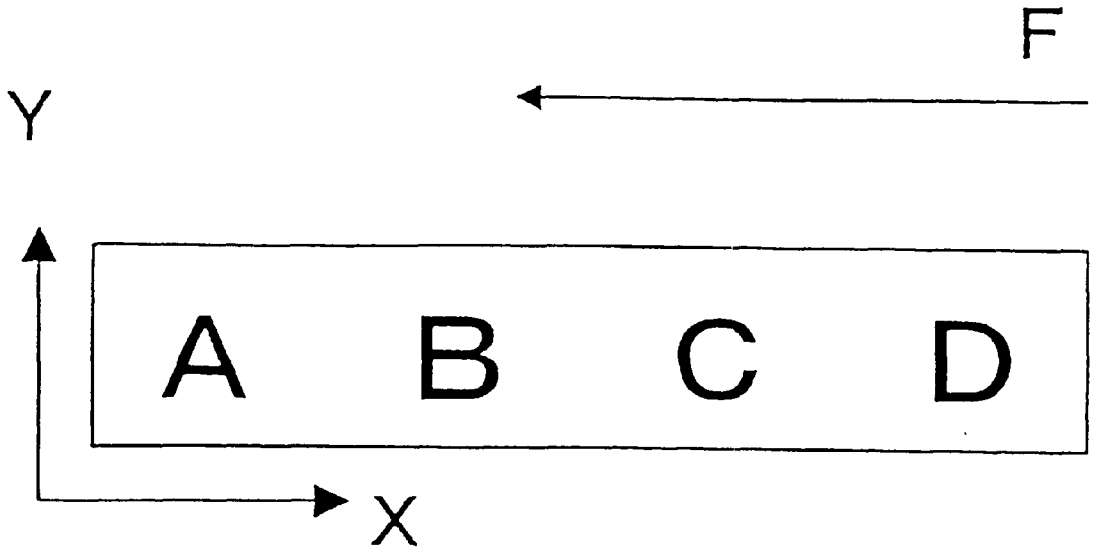
FIG. 4 is a diagram illustrating a cutting operation performed by the cutting machine according to the invention.

FIG. 4 is a schematic plan view of the sheet 5 in the side elevational view of FIG. 2, and in which the direction of extraction F of the sheet 5 is the same. In FIG. 4, F indicates the direction of feed of the sheet 5. As the driver roller 27 rotates, the sheet 5 slides on the sliding plate 3 in the direction of feed (in the direction of the arrow F) or in the direction of return (opposite to the direction of the arrow F).

In the figure, X indicates the coordinate in the longitudinal direction, and the origin is taken close to the front end of the sheet 5. Y indicates the coordinate in the widthwise direction of the sheet 5. Cutting of the sheet 5 is done by moving the cutter 19 in some trajectory on the sheet 5. That is, the cutting is done by a combination of two-dimensional operation of the cutter 19 on the sheet 5 and up-down motion of the driving arm 17. This operation is carried out based on data sent from the dedicated input terminal 42 or from the personal computer terminal 43.

With respect to the data sent to the body 1, data about a vector from some coordinates X1, Y1 on the sheet 5 to other coordinates X2, Y2 and information about up-down motion of the driving arm 17 form a unit of data. This vector data is stored in the data buffer (RAM) 44 via the interface 41. The control unit 40 processes the data in the sequence in which data are stored in the data buffer 44, and controls the operation of the pulse motor PM1, pulse motor PM2, and solenoid 22. That is, the control unit 40 delivers the aforementioned vector data in the form of information about rotation of the pulse motors PM1 and PM2 and information about up-down motion of the solenoid 22 to the various means, and the sheet 5 is cut.

Where cutting data is created using the personal computer terminal 43, the input data is processed in a batch by input software on the personal computer and then sent to the body 1. Accordingly, with respect to the cutting data sent, the cutting operation is not always started from the front end of the sheet 5. It is unknown as to from which portion of the sheet 5 does the cutting operation start.

For example, where characters "ABCD" are cut out from the sheet 5 as shown in FIG. 4, if the dedicated input terminal 42 is used, the cutting is done from the front end of the sheet 5 such that characters "A", "B", "C", and "D" are cut out in this order (in the direction of the arrow X). On the other hand, where input is performed using the personal computer terminal 43, the elements of the characters "A", "B", "C", and "D" are treated as vector data (i.e., lines). The cutting is performed without the concept of characters and irrespective of the order of the characters.

Figure 5:
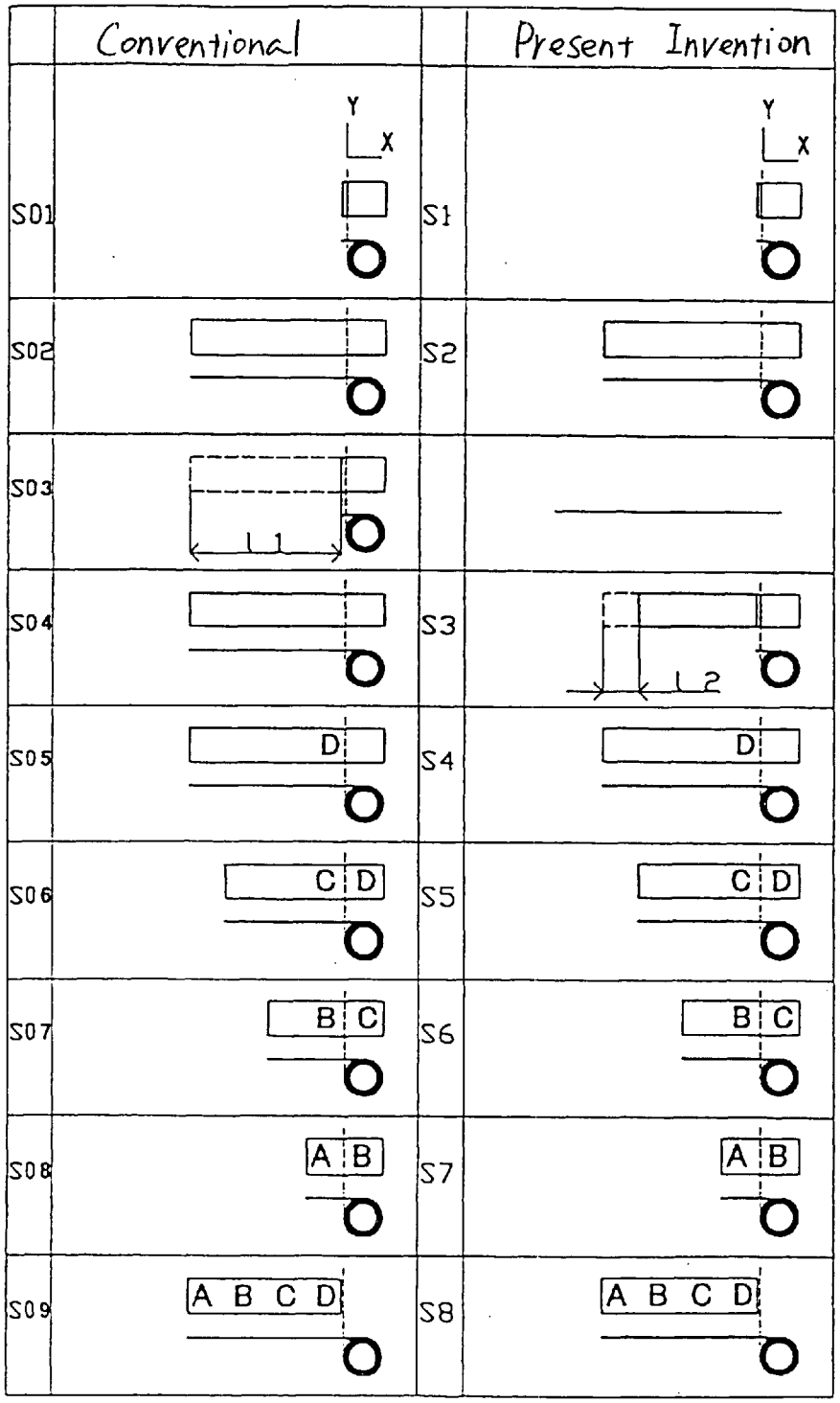
FIG. 5 is a diagram comparing the cutting machine according to the invention with the conventional one in terms of operational sequence.

The features of the cutting operation of the cutting machine according to the invention are hereinafter described while comparing them with the conventional technique. FIG. 5 is a table comparing the conventional cutting machine with the cutting operation according to the invention in terms of operation. The left column indicates the operation of the conventional cutting machine, and the right column indicates the operation of the cutting machine according to the invention. Thus, both machines are compared. Each column shows the state of the fed sheet. Characters cut out of the sheet are also shown.

The sequence of operations (S01 to S09) where the characters "ABCD" are cut out by the conventional machine is first described by referring to FIG. 5.

S01 indicates the state in which a cutting operation is not yet performed and the holes 7 on both sides of the sheet are in engagement with the driving protrusions 28 on the driver roller 27. The machine is waiting for instructions as to operations and in a standby state.

S02 indicates the state in which cutting data about characters "ABCD" to be cut out is received and a corresponding amount of sheet is fed out to check whether there is a corresponding amount of sheet left corresponding to the cutting data. At this time, where a sufficient amount of sheet is not left, the cutting operation is interrupted and the processing is ended. Where a sufficient amount of sheet is left, the process goes to next operation S03.

S03 indicates the manner in which an operation for returning the sheet, which was once fed out in the above-described S02, into the original position S01 is carried out. All conventional cutting machines are designed on the assumption that a cutting operation is performed from the front end of a sheet, so the sheet is returned once in this way. That is, the sheet is reciprocated once by the steps S01 to S03.

S04 indicates the state in which the sheet has been almost fully fed out to print "D" in the next step S05.

S05 indicates the state in which "D" has been cut out. S05 indicates the state in which "D" is first cut out in a case where cutting data is entered into the conventional cutting machine using a personal computer terminal. That is, the sheet is returned to the state of S0 once. The sheet is again fed a distance L1 shown in S03. Under this condition, cutting is done.

In the subsequent steps S06 to S09, "C", "B", and "A" are cut out while returning the sheet in steps in the direction of the arrow X in FIG. 4.

S09 indicates the state in which the portion of the sheet already cut has been fed out to cut the sheet after all the cutting operations end. The desired cutting operations end in the operational sequence described thus far.

With respect to a case in which characters "ABCD" are cut out by the cutting machine according to the invention, steps S1 to S8 are next described in turn by referring to FIG. 5.

S1 indicates a state before a cutting operation in the same way as in S01 described above. The holes 7 on both sides of the sheet are in engagement with the driving protrusions 28 on the driver roller 27. The machine is waiting for instructions as to operations and in a standby state.

S2 shows a state in which a given length of the sheet 5 has been fed out to check whether an amount of the sheet corresponding to the given cutting data remains, in the same way as in S02 described above.

Processing of S3 is different from the processing of the above-described S03. The present invention is superior to the conventional technique in this respect. That is, in S03, the sheet once fed out is returned. In S3, the sheet is not returned. Under this condition, the sheet is directly moved into a given cutting position and a cutting operation is performed.

That is, in conventional S03 to S04 described above, the sheet fed out is once returned. The sheet is again fed out a distance of L1, and "D" is cut out. In summary, in the illustrated example, the sheet is reciprocated approximately one and a half times until the cutting starts.

In contrast, in operations S3 to S4 according to the present invention, "D" is directly cut out without returning the sheet and so the cutting is started from a position moved back a slight distance of L2 from the state in which the sheet 5 is fed out to check the remaining amount. Therefore, with respect to the time taken until cutting is started, a length corresponding to one reciprocation of the sheet can be saved at maximum, compared with the conventional cutting machine.

This difference is not so great where the numbers of characters to be cut out are a few. However, where the amount of cutting data is large and the sheet is cut over several meters, comparison of both methods will reveal that the saved time is very long.

The operation of the subsequent S4 to S8 is fundamentally identical with the operation of the conventional one S05 to S09.

As described thus far, in the cutting machine according to the present invention, a sheet is fed out to check the remaining amount of sheet and then the sheet is moved from that position to a cutting position, unlike the conventional cutting machine. Therefore, the cutting machine according to the invention has the advantage that a length corresponding to approximately one reciprocation of the sheet can be saved at maximum, compared with the conventional cutting machine. One would not feel that this difference is great where the sheet to be cut is short. However, where the sheet to be cut is as long as several meters, a great difference proportional to their difference appears. In this way, the cutting machine according to the invention has the advantage that it can save a considerable cutting time, compared with the conventional one.

While only a certain embodiment of the invention has been specifically described herein, it will be apparent that numerous modifications may be made thereto without departing from the spirit and scope of the invention.

What is claimed is:

1. A cutting machine comprising:

a placement portion on which a sheet is placed so as to be movable longitudinally thereof, the sheet having a length longer than a width;

a sheet-driving unit for moving the sheet placed on said placement portion longitudinally;

a detection sensor for detecting whether the sheet placed on said placement portion is present or not;

a cutter unit movable in a direction perpendicular to the direction of movement of the sheet made by said sheet-driving unit; and a control unit for controlling said sheet-driving unit and said cutter unit, wherein said cutting machine operates both said sheet-driving unit and said cutter unit based on given input data to cut the sheet, and wherein said cutting machine calculates a length of the sheet necessary to perform a cutting operation based on said input data by means of said control unit, feeds out the sheet by said sheet-driving unit based on results of the calculation, and performs a given cutting operation based on said input data without fully returning the sheet fed out by said driving unit after said cutting machine detects whether the sheet of the necessary length found by the calculation is placed with using said detection sensor.

* * * * *